United States Patent [19]

Kelly, Jr.

[11] 4,207,762

[45] Jun. 17, 1980

[54] METHOD OF FORMING HIGH QUALITY FORGINGS

[76] Inventor: Vernon A. Kelly, Jr., 3446 Claremore Ave., Long Beach, Calif. 90808

[21] Appl. No.: 932,777

[22] Filed: Aug. 11, 1978

[51] Int. Cl.[2] ..... B21D 22/00

[52] U.S. Cl. ..... 72/360

[58] Field of Search ..... 72/359, 360, 405; 425/806

[56] References Cited

U.S. PATENT DOCUMENTS

| | | | |
|---|---|---|---|
| 168,322 | 10/1975 | Clapp | 72/360 |
| 183,761 | 10/1976 | Hammond | 72/360 |
| 1,631,623 | 6/1927 | Cochran | 72/375 |
| 2,743,478 | 5/1956 | Hodou et al. | 425/806 X |
| 2,984,865 | 5/1961 | Mumford | 425/806 |
| 3,314,278 | 4/1967 | Bergman | 72/359 X |
| 3,918,870 | 11/1975 | Tetzlaff | 425/806 X |

OTHER PUBLICATIONS

"Metals Handbook," 87th edition, vol. 5, pg. 23.

*Primary Examiner*—Leon Gilden

*Attorney, Agent, or Firm*—Blakely, Sokoloff, Taylor & Zafman

[57] ABSTRACT

A method of forming forgings having controlled grain characteristics and reduced residual stresses. In accordance with the method the amount of stock used for a particular forging preferably only slightly exceeds the amount of stock for the finished forging, with the blocking operating being controlled and performed so that the maximum flash anywhere on the part after the finishing operation and prior to trimming does not exceed a specified limit. Specifically, for the preferred method there should be a substantially equal amount of flash movement through the parting line of the finishing die around the entire periphery of the part, not exceeding a one-to-one ratio in the metal movement width through the flash land to the flash land width of the finishing die. Such control avoids excessive localized flow in the adjacent region of the forged part to avoid localized unfavorable material characteristics as a result thereof.

11 Claims, 8 Drawing Figures

METHOD OF FORMING HIGH QUALITY FORGINGS

BACKGROUND OF THE INVENTION:

1. Field of the Invention:

The present invention relates to the field of forgings.

2. Prior Art:

Forging may be defined as a process of giving metal increased utility by shaping it, refining it and improving its mechanical properties through controlled plastic deformation under impact or pressure. It is believed to be the oldest known metal working process, even being alluded to in several Old Testament accounts. "For centuries the process of hot working metal has been known and used to assure strength, toughness, reliability and highest quality in many types of products. Today the advantages of forged components assume greater importance than ever before as operating temperatures, loads and stresses increase, and reliability and toughness become more critical."

The foregoing quotation was taken from a book entitled "Forging Industry Handbook of the Forging Industry Association", and published by the Ann Arbor Press, Inc. (1966). Clearly the emphasis on forging quality has continued and will continue to take on even greater importance as the years go by in such fields as aircraft production because of the ever increasing constraints of strength, weight, absence of fatique and overall reliability in such fields.

The foregoing book provides a very good description of the prior art in general relating to various types of forging techniques,and accordingly will be referred to from time-to-time herein, both for the purposes of illuminating the prior art and for distinguishing the present invention therefrom. In terms of the definitions given in the foregoing book, the present invention is directed to impression die forging in general utilizing a closed die in the sense of distinguishing between rolling, upsetting, etc., though is not directed toward "closed die forging" as specifically defined on page 87 of the foregoing book, wherein the material being forged is to form in a cavity that allows essentially no escape of excess material, thereby effectively comprising a flashless forging process. Thus, the general type of forging for which the present invention is directed utilizes forging dies characterized by die members each having the desired die impression surrounded by a flash land, which in turn is generally surrounded by a gutter, the gutter being surrounded by a flat die surface for contacting the corresponding die surface on the mating die member. The flash land is generally a region which in cooperation with the land on the mating die defines a gap of predetermined thickness and width at the parting line through which material may be extruded during die closure to form the flash characteristic of conventional forgings prior to the trimming operation. The gutter surrounding the flash lands provides a receptacle for excess flash and/or flash remaining after previous operations and disposed or extruded outward past the flash lands as the flash lands close thereon.

In particularly simple forging shapes, forging finished dimensions could possibly be done in a single step. However, most forgings are formed utilizing at least one intermediate forging operation, generally referred to as a blocking operation, using a blocker comprising a set of dies having a cavity with a similar impression as desired on the finished forging but generally characterized by lessor detail and more generous radiuses. This reduces the required work to be performed by the finishing dies and allows the formation of an intermediate part having a material distribution, etc. chosen and varied as required to assure filling of the finishing die cavity. Generally speaking, blocking is a relatively unrestricted die forming operation in that the flow of material caused by the dies is a relatively unrestricted flow, and flash, may be considered more as a continuation of the die cavity rather than the highly restricted material flow defined in the finishing dies by the flash lands to restrict the flow of flash and provide the rapid cooling thereof, both of which cause the pressure of the material within the die cavity to greatly increase so as to encourage complete filling of the die cavity. Blocking also has a further advantage of allowing controlled working of the material to define grain orientation, etc. which will carry over into the finished forging to provide the desired directional strength characteristics. Because blockers are characterized by their relative absence of thin sections, sharp features, etc., material flow in a blocking operation is relatively modest in comparison to that experienced at least in some regions of the finishing operation, though the distribution of the material is appropriately altered to facilitate finishing. Depending upon the complexity of the forging there may be a single blocking operation followed by the finishing step, or a series of blockers may be used to progressively encourage the billet or performed stock toward a material distribution to better facilitate the finishing operation.

In forgings of various shapes and/or intricate detail it is always a problem to obtain complete filling of the finishing die cavity. In a blocker or set of blockers and a set of finishing dies which do not quite fill in one or more regions, various steps may be taken to obtain complete filling. The simplest steps generally include relieving the blocker in the appropriate area so that more material is provided on the blocked part in the region where better filling is desired, or starting with a somewhat larger stock so that the filling pressures in the finishing operation are increased, the increased material of course ultimately being ejected as additional flash during finishing. The net result is that production techniques currently in use, particularly with respect to forged parts of any complexity, will generally result in very substantial flash surrounding the finished part prior to trimming. Further, the flash typically is nonuniform, as heretofore acceptable forging techniques, even for the most demanding and precise applications, have generally not controlled or limited the amount of flash which may be obtained or assured any uniformity therein. In fact it is stated on page 101 of the foregoing book that "it should be clearly understood that any effort aimed at reducing the flash quantity or increasing the accuracy of the forging will, in most instances, lead to higher die pressures and consequently shorter die life." Thus as shown on page 264 of the foregoing book, flash formed at the sides of a forging during the forging of an automotive crank shaft of C-1046 material extends outward in a width somewhat more than half the connecting rod bearing and main bearing diameters, whereas the total flash on the connecting rod shown on page 279 of that book, relative to the size of the part, is even greater. In both cases the photos show that some flash from the blocking operation normally extends so far outward as to not contact the flash lands on the finishing dies, though in both cases, particularly the crank shaft, there is a wide region of flash shaped by and extruded through the finishing die flash lands.

Forging materials generally exhibit better ductility and strength in a direction parallel to that of the plastic elongation caused during the processing (forging) thereof. Accordingly it is common to form an elongated part such as a strut, pitman arm, etc. by the progressive elongation of a relatively short piece of stock, leading to the forging of the finished part so that the grain orientation is generally aligned with the length of the finished part.

BRIEF SUMMARY OF THE INVENTION:

A method of forming forgings having controlled grain characteristics and reduced residual stresses. In accordance with the method the amount of stock used for a particular forging preferably only slightly exceeds the amount of stock for the finished forging, with the blocking operation being controlled and performed so that the maximum flash anywhere on the part after the finishing operation and prior to trimming does not exceed a specified limit. Specifically, for the preferred method there should be a substantially equal amount of flash movement through the parting line of the finishing die around the entire periphery of the part, not exceeding a one-to-one ratio in the metal movement width through the flash land to the flash land width of the finishing die. Such control avoids excessive localized flow in the adjacent region of the forged part to avoid localized unfavorable material characteristics as a result thereof.

Figure 1:
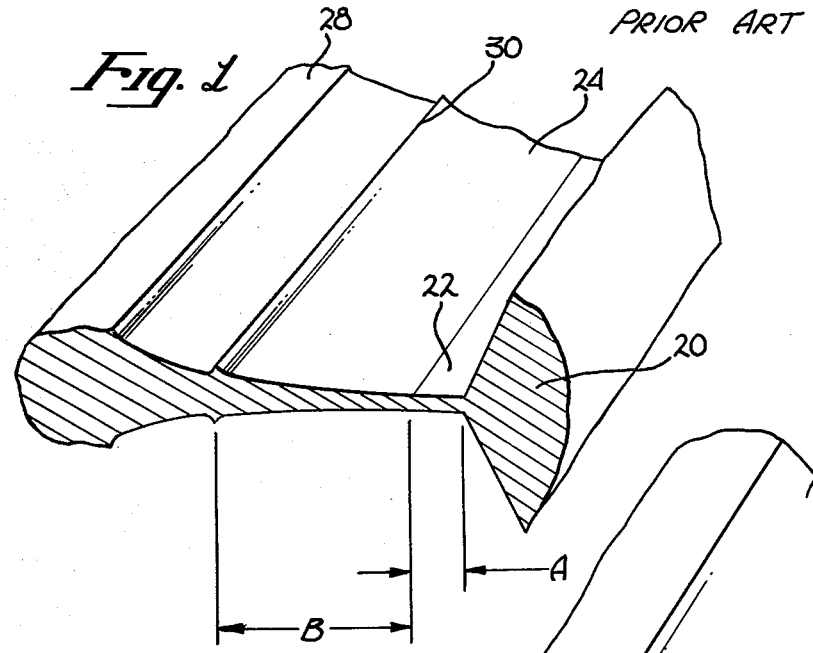
PRIOR ART Fig. 1
FIGS. 1 and 2 are cross-sections of typical finished forgings prior to trimming, illustrating characteristics of flash in accordance with prior art forging methods.

DETAILED DESCRIPTION OF THE INVENTION:

The present invention comprises a forging method whereby high quality and high strength forgings are obtained. In accordance with the invention it has been recognized that while the characteristics and properties of the flash have not heretofore been of concern because it formed no portion of the finished part, the characteristics of the flash in fact may be used as an excellent indicator of the properties and characteristics of the material in the finished part adjacent the parting line, and as an indicator of the uniformity or lack of uniformity in the residual stresses in the finished part. Specifically, the extent of flash is a direct indication of the amount of flow in the part adjacent the parting line, so that large amounts of flash are indicative of a large amount of flow and working of the finished part material adjacent the parting line. This has very pronounced adverse effects on the forging, resulting in substantial regions adjacent the parting line which are of lower strength in the load bearing orientation, which have a much higher susceptibility to fatique, and which have residual stresses uncharacteristic of the material in the finished part in the regions displaced from the parting line. Because of these residual stresses, warpage of forgings occurs after heat treat, requiring straightening operations. Distortion is often encountered again in machining, particularly with respect to unsymmetrical forgings or forgings which were formed with unsymmetrical flash, as machining in regions away from the parting line will allow the residual stresses to warp the part, whereas machining at the parting line will tend to relieve the parting line stresses to allow the part to warp back to a less stressed condition.

As previously mentioned, the amount of flash which is obtained in the finishing operation is indicative of the amount of local flow in the material of the finished part adjacent the parting line. For certain forging materials the desired structural characteristics are achieved only if the amount of working is maintained within certain limits. Obviously, if these limits are maintained in the body of the forging, a large amount of flash in the finishing operation clearly indicates that the amount of flow and working in the part adjacent the parting line far exceeds the required metal working giving the desired finished part characteristics. Further it should be noted that a local flow adjacent the parting line is outward between the finishing die flash lands. Since an elongated part such as a strut, spar, etc. has a parting line along both sides of its length, the local flow in the part adjacent the parting line is perpendicular to the length, effectively locally misorienting the grain structure with the load bearing requirement of the part. Thus, even for forging materials whose properties do not significantly deteriorate with high working levels, a weakened region is still obtained adjacent a parting line wherein large amounts of flash have been trimmed away because of the misorientation of the grain structure in this region. Since the extent of flash indicates the extent of flow, maintaining the flash at a reasonable minimum minimizes the extent of flow and thus the extent of any weaker region around the parting line. Minimizing the flash also minimizes the residual stresses from this cause, resulting in forgings uniformly exhibiting extremely low warpage after heat treat and during machining.

While the above factors have been mentioned as examples of characteristics and causes thereof resulting from a forging having a large amount of flash prior to trimming, there may be other secondary or even dominent effects caused by the large amount of flash. In particular, the very high local flow rate may have some deleterious effect, as well as the flow around the normally relatively sharp corner between the cavity and the flash land. For that matter, the relatively sharp change in direction of the grain orientation may effectively reduce the strength, fatigue resistance, flow through, etc. beyond that characteristic of either orientation. In any event, the inventor has discovered that fatigue cracks and failures on various parts tend to originate around the parting line, and that this tendency correlates with the extent of flash formed on the part during the finishing operation. The inventor has also discovered that the direction of certan types of warpage during machining of various parts is predictable by the location of the parting line and that the exent of warpage also correlates with the extent of flash in the finish forging operation. While excess material in the region of the parting line and/or relocation of the parting line may be suitable or helpful in certain instances, in other instances such steps are either not possible or not practical. By way of example, the number of critical forgings in a commmercial airliner precludes the use of any excess material, and struts, etc. by necessity must have parting lines somewhere running the length of the part. Furthermore, since forgings are used in so many critical areas of an aircraft, periodic replacement to avoid fatique is economically prohibitive unless done very sparingly, though even isolated and infrequent failures are intolerable under the circumstances.

The drawings pictorially illustrate the prior art and the preferred limits of the present invention in an exemplary manner. It is to be understood, however, that there are a number of well known variables in everyday forging practices, many of which are described herein, which are neither illustrated nor need be illustrated for an appropriate understanding of the present invention by those of reasonable skill in the art.

Figure 2:
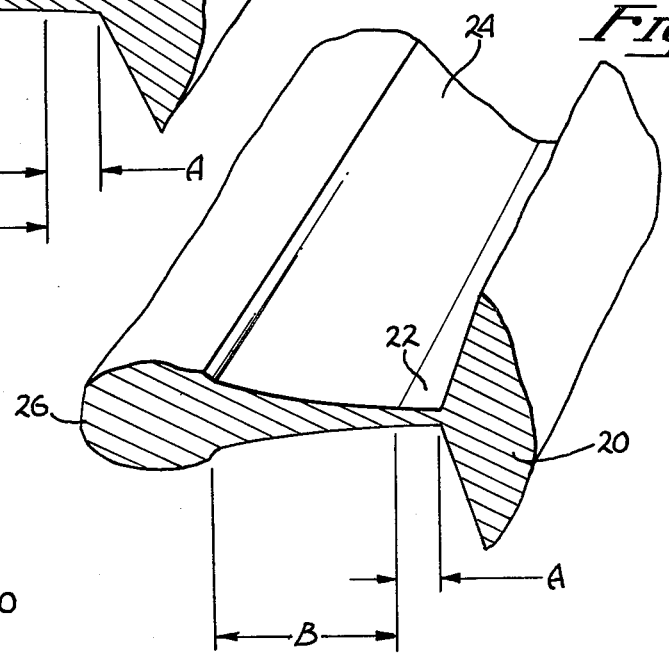
PRIOR ART Fig. 2

Referring now to FIGS. 1 and 2, cross-sections of finished die forgings prior to trimming may be seen. These figures may well represent cross-sections at various locations on a single part, grossly cut away in these figures for purposes of emphasis of the flash characteristics. The flash extending from the part 20 has certain readily identifiable characteristics. In particular, the impression of the flash lands of the finishing dies are readily observable, resulting in the clearly defined region 22 immediately adjacent the part (and thus the parting line). Outward of the flash land impression is a region 24 of increasing cross-section terminating generally at a line 30 representing the line of first contact of the outer edge of the finishing die flash land with the flash on the blocked part. The differences between the cross-section of FIG. 1 and the cross-section of FIG. 2 depend on such things as the amount of excess material in the blocked part over that required by the finished part, and the distribution of the material in the blocked part in comparison to the desired distribution of the finished part. In particular, when the part is blocked, material may or may not be extruded outward past the periphery of the outer edge of the flash lands on the blocking die before the flash lands close theron. This will determine whether an impression 37 (FIG. 1) of the outer edge of the blocker flash lands will show on the finished part.

As material is extruded outward between the flash lands during die closure, the entire flash will be forced outward, the flash land ultimately leaving the impression in region 22 in the final flash on the finished part. The width B of region 24 in FIG. 1 will depend on a number of factors. If there is little excess material on the blocked part, at least in the region of the blocked part corresponding to the cross-section of FIG. 1, then the width B of region 24 will generally be relatively small. If on the other hand there is substantial excess material on the blocked part, then all the excess must be extruded outward between the flash lands during finishing die closure, giving a relatively wide extruded region 24. Even if the flash on the blocked part does not initially overlay the outer edge of the flash lands on the finishing dies, the blocked part flash may be forced outward by the extrusion of excess material in the blocked part by the finishing dies before the flash lands close to the thickness of the flash on the blocked part, again leading to a final cross-section of the general character shown in FIG. 1. If on the other hand little flash was formed during the blocking operation and the amount of excess material on the blocked part is reasonably limited, the flash lands on the finishing dies will close on the flash on the blocked part, and together with the excess material on the blocked part, extrude that flash outward, giving a finished cross-section as shown in FIG. 2. In this case, the width of region 24 will be highly dependent upon the amount of excess material on the blocked part, as all such material must be extruded out through the flash lands.

In prior art forging processes, generally the width of the region B in the flash on the finished part, either of the type shown in FIG. 1 or the type shown in FIG. 2, is relatively wide, particularly in comparison to the width A of the flash lands on the finishing dies defining region 22. In prior art forging processes, ratios of B/A or 5 to 1, or even 10 to 1 at various locations on a forged part are relatively common, the ratio, however, varying substantially around the part. In that regard, there may be localized regions where to ratio is 1 to 1 or less, or where the flash land gap does not even entirely fill, though any such region is indicative of no flash on the blocked part in that region and only marginal filling of the finish die cavity in that region. Such instances on a localized basis are not in accordance with the present invention, as one aspect of the present invention is uniformity of flash as well as the control thereof to achieve the desired results. (Flash land width may be different at different regions around a part, and if so, the ratio B/A described herein and as used in the claims relates to local ratios, i.e., ratios based on the local flash land width.)

Figure 3:
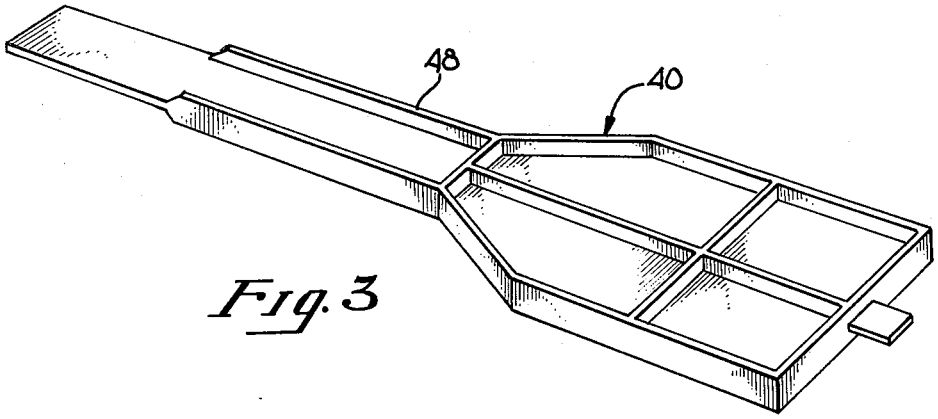
FIG. 3 is a perspective view of a typical forging of a complex nature.
Figure 4:
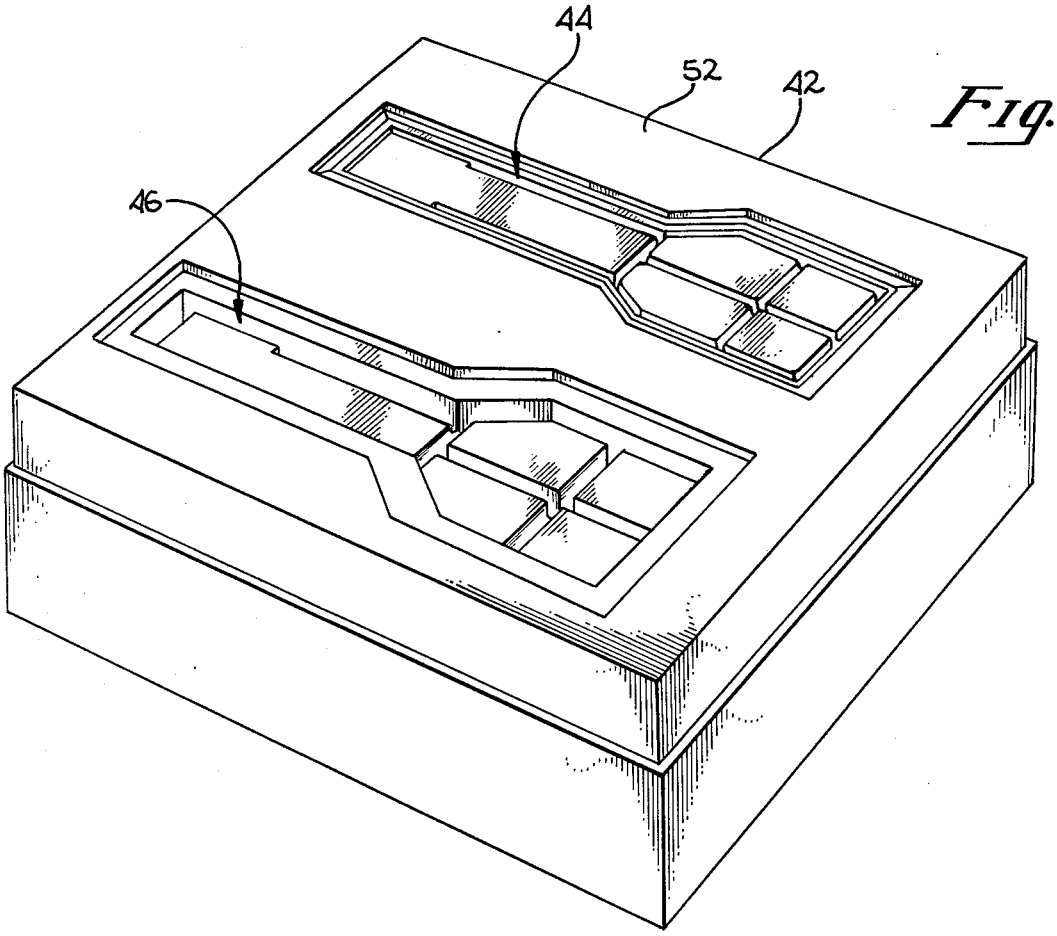
FIG. 4 is a perspective view of a die base illustrating a blocking and a finishing cavity.
Figure 5:
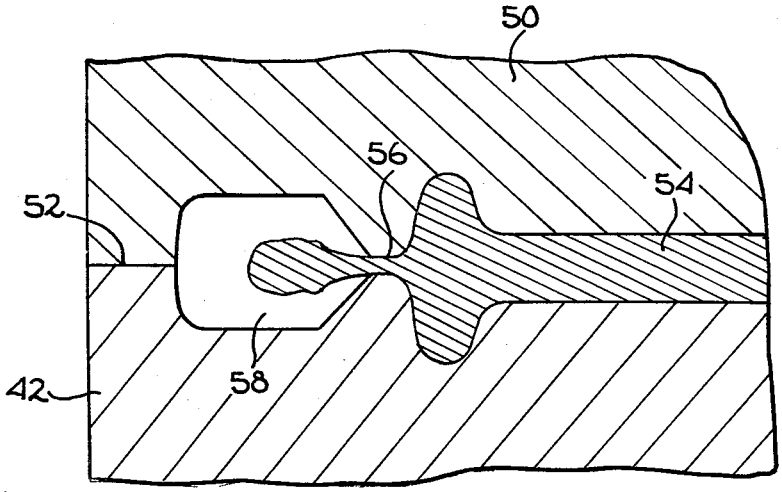
FIG. 5 is a cross-section of a portion of the blocking cavity of FIG. 4.
Figure 6:
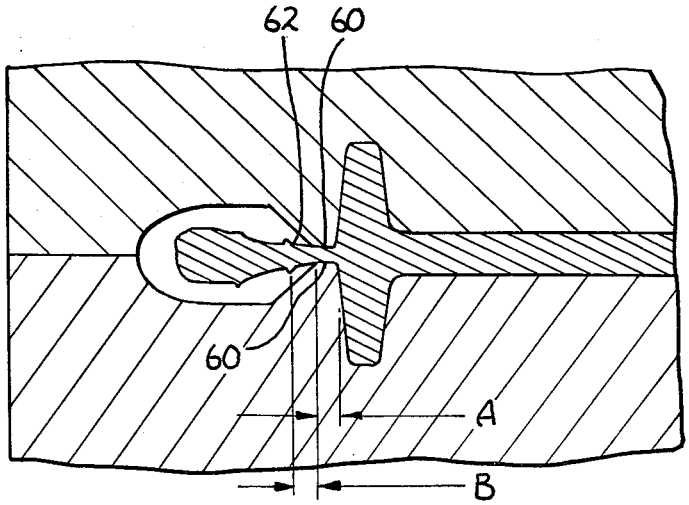
FIG. 6 is a cross-section of the finishing die cavity in a region corresponding to that of FIG. 5.

In comparison to the prior art described hereinbefore, particulary with reference to FIGS. 1 and 2, the remainder of the figures provide an exemplary illustration of a part forged in accordance with the principles of the present invention. In particular, FIG. 3 presents a perspective view of a representative finished forged part 40 illustrating a part of varying width and having reinforcing ribs in some areas but not others. FIG. 4 illustrates a die base 42 having a blocking cavity generally indicated by the numeral 44 and a finishing cavity generally indicated by the numeral 46. As previously mentioned, the blocking cavity, in this case the final blocking cavity as such a part is most likely forged using a series of blockers, is similar to the finishing cavity though with less pronounced features. Thus, by way of example, a typical cross-section of the blocking dies in the region of the reinforcing webs such as the web 48 of FIG. 3 is shown in FIG. 5. In particular the lower die base 42 and the upper die base 50 meet in the region of their periphery 52 to define a blocker cavity while forming a blocked part 54, in this instance having a slight amount of flash 56 spreading into the flash region 58 provided for this purpose. It should be noted that the region for flash commonly provided on blocker dies is relatively thick, compared to the finished part. When the blocked part is finished as shown in FIG. 6, the flash 56 will extend outward through the flash lands 60 (having a width A) into region 62 having a width B. In accordance with the present invention method, the blocked part, at least as formed in the final blocking dies, is given a material volume and distribution such that the finishing cavity will fill, maintaining around the entire periphery a uniform flash wherein the extension beyond the flash land B does not exceed the flash land width A, or the ratio B/A does not exceed 1.

Figure 7:
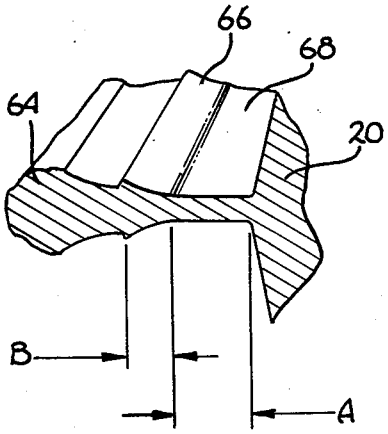
FIG. 7 is a cross-section of the flash on a finished forging in accordance with the present invention method.

It will be noted that the example of FIG. 6 corresponds in general form with the prior art illustrated with respect to FIG. 2, though the extended region 24 of FIG. 2 is non-existent. Instead, the equivalent of this region is held to a width equal to or less than the flash land width, basically by avoidance of the extrusion of substantial material through the flash lands, a result achieved by the combination of very minimal excess material in the blocked part and appropriate distribution of the material in the blocked part so as to avoid large flash in some regions at the expense of filling in other regions. (Or even at the expense of filling in the region of large flash because of inappropriate material distribution in the blocked part across the cross-section in that region). The present invention, however, is not limited to practice on blocked parts having minimal flash, but can also be applied to situations where the flash resulting from the last blocking operation approaches or even exceeds the boundary of the flash land of the finished dies. In particular, the resulting flash on the finished part 20 in such a situation is illustrated in FIG. 7. In essence there is a region 64 representing a carry-over of a portion of the blocking flash, with the region 66 having a relatively narrow width B, in particular equal to or less than the region 68 defined by the flash lands. In such a situation very little material has been extruded through the flash lands during the finishing operation, but instead the flash lands have merely effectively closed on the flash remaining from the blocking operation to merely "bit off" the material in that region. As such, the flash on the blocked part is merely squeezed, essentially extruding some of that material outward, but creating an inward pressure inhibiting or preventing extrusion of any material outward form the finishing cavity through the parting line so that the extent of working or flow of the material in the finished part immediately adjacent the parting line is very nearly identical to the bulk material in the forged part, and the region of influence of the parting line of the properties of any material in the finished part is extremely limited. This result is directly opposite of that achieved in the prior art with respect to FIGS. 1 and 2, as the extrusion of relatively large amounts of material through the flash lands during the finishing operation creates a highly pronounced flow pattern in the part adjacent the parting line, having a deleterious influence over a substantial fraction of the cross-section of the finished part.

Since the net result of maintaining the flash to a minimum in accordance with the present invention is to create minimum influence of the parting line on the adjacent material in the finished part, minimum stresses caused by the parting line per se are imposed on the finished forging. Accordingly, one primary cause of warpage during machining as recognized by the inventor is essentially eliminated, allowing the ready manufacture of machined forgings of greater tolerance or alternatively, providing a greater yield of machined forgings of particularly critical tolerances.

In order to practice the present invention, certain procedures must be generally followed. In particular, in prior art forging methods a set of blockers and a finishing die will be fabricated by a die maker which, based on accumulated experience, are most likely to provide filling of the finished die cavity and to yield a part of the required dimensional and grain orientation characteristics. In the prior art method of design, substantial excess material will be provided for in the blocked part to provide substantial extrusion through the flash lands of the finishing die to encourage filling of the finishing die cavities. In accordance with the present invention the amount of excess material in the blocked part, neglecting any flash thereon, will be held to a minimum readily calculable by the flash land width, thickness and circumference so that on the average the ratio of B/A may be held to less than 1. Typically as the dies are being developed, the first parts forged will exhibit incomplete filling of the finishing dies in at least some areas, as development of an appropriate die system, even in the prior art, typically involves some trial and error. While prior art techniques for correcting incomplete filling include both adding material to the blocked part in appropriate locations with or without removing an equivalent amount of material from some other location, development of a die set to practice the present invention would require the addition of material in some regions to encourage filling with a corresponding removal of an equal amount of material from some other region in the blocked part to maintain the total amount of material in the blocked part to only very slightly greater than that required to fill the finishing cavity. In essence in the present invention method, the blocking operation is to provide a blocked part which will just fill the finishing die cavity, with development of the blockers being concerned with the redistribution of that fixed amount of material as required to obtain filling of the finishing die cavity. One technique which appears to aid in developing a die set is to design and cut the blocker and finishing cavities and run a few parts (block and finish die to die). The parts will probably show excess flash in some areas and lack of fill in others. Then, while still blocking die to die, one may back off on the finishing closure until maximum flash is within the set limit for B/A, and adjust (deepen) the blocker cavity locally until other areas fill and exhibit the desired B/A. Then face each blocker die and resink blocker flash lands by an amount equal to one-half the distance the finishing dies were backed off from die to die (also restore radii adjacent flash lands in blocker cavities). If blocker and finisher are on the same die bases (see FIG. 4), the finishing cavities will have to be resunk by the same amount. Final adjustments are then made based on filling and metal flow considerations.

Figure 8:
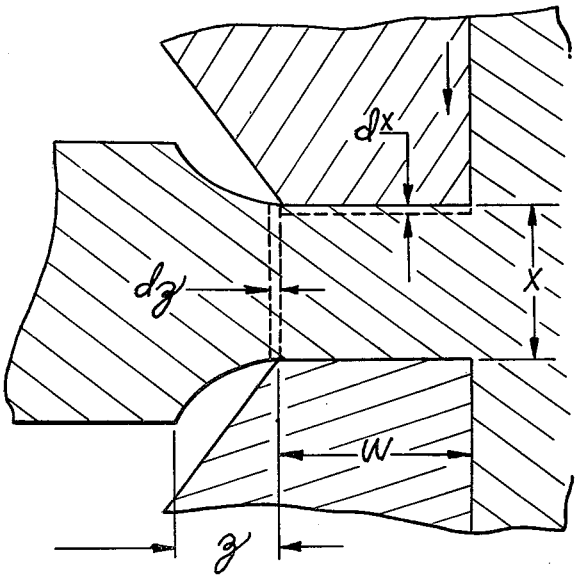
FIG. 8 is a schematic cross-section illustrating the forming of flash during finishing.

The preferred method in accordance with the present invention has been described herein as one wherein flash is limited in relation to the flash land of the finishing die to a ratio not exceeding 1-to-1. It is to be noted that this ratio has been stated as a ratio independent of the thickness of the flash provided in the blocking operation and/or the thickness of the flash in the finishing operation. A basis for the inventor's discovery and alternate ways of identifying appropriate limits for the practice of the invention can be derived as follows. In particular, the following analysis proceeds utilizing FIG. 8 as a reference. In the analysis, it will be assumed that the inner limit of the flash lands effectively "bites off" the flash remaining from the blocking operation so that there is no net material flow into or out of the finishing die cavity. Thus, all of the material between the flash lands of the finishing die is assumed extruded outward during the finishing operation. In the analysis, the following parameters are used:

Let $x$ = flash land separation at any point during closure $x_o$ = blocker flash thickness $x_f$=finished part flash thickness
z=flash length at any point during closure
Z=final flash length
W=flash land width With these variables, the flash lands on the finishing dies close on the flash remaining from the blocking operation when their separation equals $X_o$, extruding the material therebetween outward until reaching the finished part flash thickness of $X_f$. The amount of material being extruded outward per unit length along the flash land during an incremental die closure motion of $-dx$ is $<Wdx$. At this time, the thickness of the flash being extruded at the point of exit of the flash from the flash lands is x. Consequently, the amount of material added to the flash per unit of length along the flash lands is xdz. Thus, $$-Wdx = xdz$$
$$-dz/W = dx/x$$
$$-\int_0^Z dz/W = \int_{X_o}^{X_f} dx/x$$

or $Z/W=\ln(X_o/X_f)$ where Z=final flash length (EQUATION 1)

if $X_o/X_f=2$, then $Z/W=B/A=0.7$
if $X_o/X_f=2.7$, then $Z/W=B/A=1.0$

The foregoing method of analysis may be used to establish some interesting limits. By way of example, if no finishing cavity filling pressures were required, i.e., the finishing die flash lands merely close on the flash on the blocked part, extruding half of it inward and half of it outward, then the amount of material being extruded outward for an incremental die closure motion of $-dx$ is $-(W/2)dx$. This gives a final equation as follows:

$$2Z/W=\ln(X_o/X_f) \quad \text{(EQUATION 2)}$$

if $X_o/X_f=2$, then $Z/W=B/A=0.35$
if $X_o/X_f=2.7$, then $Z/W=B/A=0.5$

In accordance with the foregoing, closure of the finishing die lands on the flash of a blocked part using a flash thickness ratio of 2-to-1 will still yield a ratio B/A of approximately 0.35, even if ½ the flash is extruded inward into the cavity, obviously a limiting condition, as some filling pressure causing more flow outward than inward can normally be expected. Again, if a tolerance and/or the radius between the flash and the blocked part itself yield a ratio $X_o/X_f$ of approximately 2.7, then B/A=0.5.

It will be noted that the ratio Z/W in Equation 1 is actually the ratio of B/A previously stated, as Z is the final flash extension and W is the flash land width. Common forging die design practice generally allows for flash on the blocked part of approximately twice the thickness of the flash on the finished part, giving the ratio $X_o/X_f=2$. This yields a ratio of Z/W or B/A of approximately 0.7. In that regard, it will be noted that the analysis assumes that the material being extruded outward at any time is exiting at a uniform rate throughout the thickness of the flash, an approximation made for purposes of analysis only. In addition, normally a blocked part will have a generous radius between the blocked part and the flash thereon, so that the flash lands begin closing on that radius also. If the effective or average $X_o/X_f$, considering tolerances and the radius of the flash of the blocked part, is approximately 2.7, then Z/W=B/A=1.0. Accordingly, the ratio B/A for zero flow into or out of the final part may vary somewhat, though it may be seen that the ratio recognized by the inventor as being a preferred limit can be related to an ideal, though approximate analytical result.

In a practical situation, it would be impossible to hold the net flow to or from the part through the parting line at exactly zero, particularly throughout the entire length of the parting line. Accordingly, as an approximation of possible alternate upper limits on the ratio B/A which are tolerable, another analytical possibility is considered. In particular, if it is assumed that not only is the flash remaining from the blocking operation extruded outward through the flash lands during finishing die closure, but also an equal amount of material from the part being forged is similarly extruded from the part into the flash lands (some of which is extruded through the flash lands), then for an incremental finishing die closure motion of $-dx$, the amount of material extruded outward past the outer edge of the flash lands is $-2Wdx$. Solving the equations again yields the following:

$$Z/2W=\ln(X_o/X_f) \quad \text{(EQUATION 3)}$$

if $X_o/X_f=2$, then $Z/W=B/A=1.4$
if $X_o/X_f=2.7$, then $Z/W=B/A=2.0$

Thus, in this situation, for a ratio $X_o/X_f=2$, the ratio B/A=1.4, whereas if the effective ratio of $X_o/X_f$ is approximately 2.7, then B/A=2.0. This condition, as previously mentioned, is providing for a flow out of the part into the flash lands, though the material flow is at least limited to some reasonable amount.

In summary of the foregoing, it will be noted that if relatively negligible net flow of material out of the part and between the flash lands is to be maintained during the finishing operation, then the preferred limit of B/A=1 provides an appropriate upper limit using conventional blocker and finishing die flash thicknesses. If, on the other hand, some reasonable flow from the part during finishing is acceptable, then an upper limit of B/A=1.5 may be tolerated. Finally, a ratio of B/A=2 represents substantial flow from the part which may be expected not to result in optimum properties therein, but which may be acceptable as a compromise in some situations or, perhaps more appropriately, where for various reasons the ratio $X_o/X_f$ is significantly higher than 2. It is to be understood, though, in accordance with conventional forging practices regarding flash thicknesses, that a ratio of B/A=2 will in general result in a less desirable part than for the preferred limit of B/A=1 or even the limit of B/A=1.5. If, on the other hand, the flash thickness ratios $X_o/X_f$ vary significantly from a ratio of 2-to-1, it may be more appropriate to define the desired flash extension ratio of B/A as approximately $\ln(X_o/X_f)$ when $X_o$ is the average or effective flash thickness on the blocked part, with the ideal limit being approximately $B/A=\ln(X_o/X_f)$, and an appropriate upper limit being approximately $2\ln(X_o/X_f)$.

There has been described herein a new and unique forging method which will result in a high-quality forgings characterized by high strength, proper grain orientation and high resistance to fatigue. Both the preferred method of practicing the invention and various other limits have been described in detail herein. Generally, it is contemplated that these limits be maintained all along the parting line of any particular forging, though it is to be understood that in some instances, superior qualities may be required in some areas of the forging but not in others because of excess material being located there, etc., in which instances the limits described herein with respect to the invention may be applied only to the more critical areas and/or varying limits applied to various regions of a particular forging, taking into account the structural and functional requirements of each area of the forging. Thus, while the present invention has been disclosed and described herein with respect to preferred forms of practicing the invention, it will be understood by those skilled in the art that various changes may be made therein without departing from the spirit and scope of the invention.

I claim:

1. A method of forming high quality forgings utilizing forging dies characterized by die members each having the desired die impression surrounded by a flash land which in turn is generally surrounded by a gutter, the gutter being surrounded by a flat die surface for contacting the corresponding die surface on the mating die member, comprising the steps of (a) forming a blocked part having an amount of material in the blocked part substantially equal to the material in the desired finished part, and (b) forging a finished part from the blocked part, the finished part having a controlled flash extension over at least a predetermined portion of the parting line adjacent the region of the part where material characteristics are to be controlled, the controlled flash extension being characterized by a finishing die flash extension ratio B/A of less than 2-to-1; where A is the flash land width of the finishing die and B is the length of flash extension formed by the finishing die flash lands in the finishing operation as measured from the outer edge of the final flash land impression and the line of first contact of the outer edge of the finishing die flash land with the material therebetween.

2. A method of forming high quality forgings utilizing forging dies characterized by die members each having the desired die impression surrounded by a flash land which in turn is generally surrounded by a gutter, the gutter being surrounded by a flat die surface for contacting the corresponding die surface on the mating die member, comprising the steps of (a) forming a blocked part having an amount of material in the blocked part substantially equal to the material in the desired finished part, and (b) forging a finished part from the blocked part, the finished part having a controlled flash extension over at least a predetermined portion of the parting line adjacent the regions of the part where material characteristics are to be controlled, the controlled flash extension being characterized by a finishing die flash extension ratio B/A of less than 1.5-to-1; where A is the flash land width of the finishing die and B is the length of flash extension formed by the finishing die flash lands in the finishing operation as measured from the outer edge of the final flash land impression and the line of first contact of the outer edge of the finishing die flash land with the material therebetween.

3. A method of forming high quality forgings utilizing forging dies characterized by die members each having the desired die impression surrounded by a flash land which in turn is generally surrounded by a gutter, the gutter being surrounded by a flat die surface for contacting the corresponding die surface on the mating die member, comprising the steps of (a) forming a blocked part having an amount of material in the blocked part substantially equal to the material in the desired finished part, and (b) forging a finished part from the blocked part, the finished part having a controlled flash extension over at least a predetermined portion of the parting line adjacent the regions of the part where material characteristics are to be controlled, the controlled flash extension being characterized by a finishing die flash extension ratio B/A of less than 1-to-1; where A is the flash land width of the finishing die and B is the length of flash extension formed by the finishing die flash lands in the finishing operation as measured from the outer edge of the final flash land impression and the line of first contact of the outer edge of the finishing die flash land with the material therebetween.

4. A method of forming high quality forgings utilizing forging dies characterized by die members each having the desired die impression surrounded by a flash land which in turn is generally surrounded by a gutter, the gutter being surrounded by a flat die surface for contacting the corresponding die surface on the mating die member, comprising the steps of (a) forming blocked part having an amount of material in the blocked part substantially equal to the material in the desired finished part, and (b) forging a finished part from the blocked part, the finished part having a controlled flash extension over at least a predetermined portion of the parting line adjacent the regions of the part where material characteristics are to be controlled, the controlled flash extension being characterized by a finishing die flash extension ratio B/A of less than 2 ln $(X_o/X_f)$; where A is the flash land width of the finishing die, B is the length of flash extension formed by the finishing die flash lands in the finishing operation as measured from the outer edge of the final flash land impression and the line of first contact of the outer edge of the finishing die flash land with the material therebetween, $X_o$ is the effective flash thickness on the blocked part, and $X_f$ is the flash thickness on the finished part.

5. A method of forming high quality forgings utilizing forging dies characterized by die members each having the desired die impression surrounded by a flash land which in turn is generally surrounded by a gutter, the gutter being surrounded by a flat die surface for contacting the corresponding die surface on the mating die member, comprising the steps of (a) forming a blocked part having an amount of material in the blocked part substantially equal to the material in the desired finished part, and (b) forging a finished part from the blocked part, the finished part having a controlled flash extension over at least a predetermined portion of the parting line adjacent the regions of the part where material characteristics are to be controlled, the controlled flash extension being characterized by a finishing die flash extension ratio B/A of approximately ln $(X_o/X_f)$; where A is the flash land width of the finishing die, B is the length of the flash extension formed by the finishing die flash lands in the finishing operation as measured from the outer edge of the final land impression and the line of first contact of the outer edge of the finishing die flash land with the material therebetween, $X_o$ is the effective flash thickness on the blocked part, and $X_f$ is the flash thickness on the finished part.

6. A method of forming high quality forgings utilizing forging dies characterized by die members each having the desired die impression surrounded by a flash land which in turn is generally surrounded by a gutter, the gutter being surrounded by a flat die surface for contacting the corresponding die surface on the mating die member, comprising the steps of (a) forming a blocked part having an amount of material in the blocked part substantially equal to the material in the desired finished part and having a material distribution for filling the finishing die cavity while providing a predetermined flash extension on at least a predetermined portion of the parting line of the finished part to avoid substantial material flow past the inner periphery of the finishing die flash lands into and out of the finishing die cavity, and (b) forging the finished part from the blocked part.

7. The method of claim 6 wherein the predetermined flash extension on the finished part is characterized by a finishing die flash extension ratio B/A of less than 2-to-1; where A is the flash land width of the finishing die and B is the length of flash extension formed by the finishing die flash lands in the finishing operation as measured from the outer edge of the flash land impression and the line of first contact of the outer edge of the finishing die flash land with the material therebetween.

8. The method of claim 6 wherein the predetermined flash extension on the finished part is characterized by a finishing die flash extension ratio B/A of less than 1.5-to-1; where A is the flash land width of the finishing die and B is the length of flash extension formed by the finishing die flash lands in the finishing operation as measured from the outer edge of the final flash land impression and the line of first contact of the outer edge of the finishing die flash land with the material therebetween.

9. The method of claim 6 wherein the predetermined flash extension on the finished part is characterized by a finishing die flash extension ratio B/A of less than 1-to-1; where A is the flash land width of the finishing die and B is the length of flash extension formed by the finishing die flash lands in the finishing operation as measured from the outer edge of the final flash land impression and the line of first contact of the outer edge of the finishing die flash land with the material therebetween.

10. The method of claim 6 wherein the predetermined flash extension on the finished part is characterized by a finishing die flash extension ratio B/A of less than 2 ln $(X_o/X_f)$; where A is the flash land width of the finishing die, B is the length of flash extension formed by the finishing die flash lands in the finishing operation as measured from the outer edge of the final flash land impression and the line of first contact of the outer edge of the finishing die flash land with the material therebetween, $X_o$ is the effective flash thickness on the blocked part, and $X_f$ is the flash thickness on the finished part.

11. The method of claim 6 wherein the predetermined flash extension on the finished part is characterized by a finishing die flash extension ratio B/A of approximately ln $(X_o/X_f)$; where A is the flash land width of the finishing die, B is the length of flash extension formed by the finishing die flash lands in the finishing operation as measured from the outer edge of the final flash land impression and the line of first contact of the outer edge of the finishing die flash land with material therebetween, $X_o$ is the effective flash thickness on the blocked part, and $X_f$ is the flash thickness on the finished part.

* * * * *